US009542790B2

(12) United States Patent
Zhu et al.

(10) Patent No.: US 9,542,790 B2
(45) Date of Patent: Jan. 10, 2017

(54) CASH RECYCLING SYSTEM AND BANKNOTE SEPARATING DEVICE THEREOF

(71) Applicant: GRG Banking Equipment Co., Ltd., Guangzhou, Guangdong (CN)

(72) Inventors: Yuehui Zhu, Guangdong (CN); Zhiqiang Sun, Guangdong (CN); Zhuang Jiang, Guangdong (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 15/108,371

(22) PCT Filed: Oct. 30, 2014

(86) PCT No.: PCT/CN2014/089875

§ 371 (c)(1),
(2) Date: Jun. 27, 2016

(87) PCT Pub. No.: WO2015/180407

PCT Pub. Date: Dec. 3, 2015

(65) Prior Publication Data

US 2016/0321853 A1 Nov. 3, 2016

(30) Foreign Application Priority Data

May 30, 2014 (CN) ..... 2014 1 0240095

(51) Int. Cl.
*G07D 11/00* (2006.01)
*B65H 3/06* (2006.01)
*B65H 7/02* (2006.01)

(52) U.S. Cl.
CPC ..... *G07D 11/0021* (2013.01); *B65H 3/0638* (2013.01); *B65H 3/0684* (2013.01);
(Continued)

(58) Field of Classification Search
CPC ..... B65H 2701/1912; B65H 2301/42324; B65H 2404/65; B65H 3/0684; B65H 3/0638; G07D 11/0036; G07D 11/0021
(Continued)

(56) References Cited

U.S. PATENT DOCUMENTS 6,003,652 A 12/1999 Murata et al.
7,758,045 B2 * 7/2010 Ko ..... B65H 29/40 271/315

(Continued)

FOREIGN PATENT DOCUMENTS

CN 101770663 A 7/2010
CN 201749511 U 2/2011

(Continued)

OTHER PUBLICATIONS

International Search Report for PCT/CN2015/089875, mailed Mar. 6, 2015, ISA/CN.

*Primary Examiner* — Patrick Cicchino
(74) *Attorney, Agent, or Firm* — U.S. Fairsky LLP; Yue Xu

(57) ABSTRACT

A cash recycling system and a banknote separating device thereof are provided. The banknote separating device includes a supporting side plate, and an impeller wheel assembly, a banknote separating assembly, a first banknote pressing assembly and a second banknote pressing assembly mounted to the supporting side plate. The first banknote pressing assembly includes a first banknote pressing plate and a synchronous belt pulley mechanism configured to drive the first banknote pressing plate, and the synchronous belt pulley mechanism includes two synchronous pulleys and a synchronous belt sleeved on the synchronous pulleys. With the banknote separating device, the structure is simplified, the banknote clamping risk is reduced, and the reliability is improved.

14 Claims, 8 Drawing Sheets

(52) U.S. Cl.
CPC ..... *B65H 7/02* (2013.01); *G07D 11/0036* (2013.01); *B65H 2301/42324* (2013.01); *B65H 2404/65* (2013.01); *B65H 2408/11* (2013.01); *B65H 2701/1912* (2013.01)

(58) Field of Classification Search
USPC ..... 271/315, 187
See application file for complete search history.

(56) References Cited

U.S. PATENT DOCUMENTS

| | | | | |
|---|---|---|---|---|
| 2006/0151939 | A1* | 7/2006 | Park | B65H 1/025 271/207 |
| 2013/0241138 | A1 | 9/2013 | Chen et al. | |
| 2014/0238814 | A1* | 8/2014 | You | B65H 3/0607 194/206 |
| 2015/0175375 | A1 | 6/2015 | Jiang et al. | |
| 2015/0302680 | A1 | 10/2015 | Guo et al. | |

FOREIGN PATENT DOCUMENTS

| | | | |
|---|---|---|---|
| CN | 201773438 | U | 3/2011 |
| CN | 102819892 | A | 12/2012 |
| CN | 103035062 | A | 4/2013 |
| CN | 103136847 | A | 6/2013 |
| CN | 103177504 | A | 6/2013 |
| CN | 103268661 | A | 8/2013 |
| CN | 103985192 | A | 8/2014 |
| JP | H109147193 | A | 6/1997 |
| JP | 2001236546 | A | 8/2001 |

* cited by examiner

CASH RECYCLING SYSTEM AND BANKNOTE SEPARATING DEVICE THEREOF

This application is the national phase of International Application No. PCT/CN2014/089875, titled "CIRCULATION ALL-IN-ONE MACHINE AND BANK NOTE DISTRIBUTING DEVICE THEREOF", filed on Oct. 30, 2014, which claims the benefit of priority to Chinese Patent Application No. CN201410240095.4, titled "CASH RECYCLING SYSTEM AND BANKNOTE SEPARATING DEVICE THEREOF", filed with the Chinese State Intellectual Property Office on May 30, 2014, the entire disclosure of which application is incorporated herein by reference.

FIELD

The present application relates to a financial self-service equipment, and more particularly to a banknote separating device with a simplified structure and a cash recycling system having the banknote separating device.

BACKGROUND

A banknote separating module performs banknote separating as well as banknote clamping and conveying in processes of banknote disposing, banknote depositing, banknote withdrawing, banknote picking, forgotten banknote recovering, etc. In a conventional cash recycling system, a banknote separating module performs the processes of banknote depositing, banknote withdrawing and forgotten banknote recovering by two up and down banknote separating assemblies. Also, for achieving up and down separating of banknotes, and clamping and conveying of banknotes in the above three processes, generally three banknote pressing plates are provided in the banknote separating module, and the three banknote pressing plates are driven by three motors and six synchronous belts to move to achieve various states.

SUMMARY

For addressing the issue of a complicated structure, a high cost, and a high banknote jamming risk of a banknote separating module in the conventional technology, a banknote separating device is provided according to the present application, in which one banknote separating assembly and one banknote separating motor are reduced, thus reducing the banknote jamming risk, improving the reliability, reducing difficulties in assembling, manufacturing, and testing, and reducing the cost.

A cash recycling system having the banknote separating device is further provided according to the present application.

The banknote separating device includes: a supporting side plate, and an impeller wheel assembly, a banknote separating assembly, a first banknote pressing assembly, and a second banknote pressing assembly which are all mounted on the supporting side plate, the first banknote pressing assembly includes a first banknote pressing plate and a synchronous belt pulley mechanism configured to drive the first banknote pressing plate, the synchronous belt pulley mechanism includes two synchronous pulleys and a synchronous belt sleeved on the synchronous pulleys, one of the synchronous pulleys is mounted at one end of a rotatable plate by a first riveting shaft, and another end of the rotatable plate is mounted on the supporting side plate by a second riveting shaft, the rotatable plate is rotatable about the second riveting shaft, and each of the supporting side plate and the rotatable plate includes a sliding slot, the first banknote pressing plate is mounted in the sliding slot of the rotatable plate via a bearing and extends into the sliding slot of the supporting side plate, and the first banknote pressing plate is connected to the synchronous belt via a belt connecting plate and moves forward and backward in the sliding slot of the rotatable plate with rotating of the synchronous belt; and the second banknote pressing assembly includes a second banknote pressing plate and a crank-rocker mechanism configured to drive the second banknote pressing plate, the crank-rocker mechanism includes a direct current motor fixed to the supporting side plate, a crank fixed to a motor shaft of the direct current motor, a connecting rod connected to the crank, and a rocker connected to the connecting rod, another end of the rocker is fixed to a shaft, and the second banknote pressing plate is fixed to the shaft by a banknote pressing bracket. In the case that the crank-rocker mechanism moves, the rocker rocks back and forth, to drive the shaft to rotate back and forth, thus driving the banknote pressing bracket and the second banknote pressing plate fixed to the shaft to rock back and forth.

Specifically, the banknote separating device further includes a banknote baffle and a banknote picking wheel. The banknote separating assembly includes a banknote separating wheel located below the banknote picking wheel.

Specifically, the second banknote pressing plate and the first banknote pressing plate are arranged in order between the impeller wheel assembly and the banknote baffle, a banknote input space is formed between the banknote baffle and the first banknote pressing plate, and a banknote output space is formed between the first banknote pressing plate and the second banknote pressing plate.

Preferably, the banknote separating device further includes a pair of first U-shaped sensors located on a rear side of the banknote picking wheel, one of the first U-shaped sensors is configured to detect whether the first banknote pressing plate is lifted in place to avoid the banknote picking wheel, and the other one of the first U-shaped sensors is configured to detect whether the first banknote pressing plate and the banknote picking wheel press the banknotes in place to control starting of the banknote picking wheel.

Preferably, the first banknote pressing assembly further includes a pair of second U-shaped sensors, one of the second U-shaped sensors is configured to control a position of the first banknote pressing plate in a banknote withdrawing process, and the other one of the second U-shaped sensors is configured to control the position of the first banknote pressing plate in a banknote disposing process.

Preferably, the second banknote pressing assembly further includes a pair of third U-shaped sensors, one of the third U-shaped sensors is configured to control an initial position of the second banknote pressing plate in performing a banknote withdrawing process, a banknote disposing process, and a banknote depositing process, and the other one of the third U-shaped sensors is configured to control the position of the second banknote pressing plate in a banknote picking process.

Preferably, an opening is provided at an end, close to the banknote picking wheel, of the sliding slot of the supporting side plate, and the opening is provided with an inclined surface extending upward, and the first banknote pressing plate is movable upward along the inclined surface. In the process of the first banknote pressing plate moving upward along the inclined surface and being lifted up, the first banknote pressing plate avoids the banknote picking wheel, to allow the second banknote pressing plate to directly cooperate with the banknote picking wheel, in order that the banknote separating device may perform the forgotten banknote recovering function.

A cash recycling system is further provided in the present application, which includes any one of the above banknote separating devices.

The banknote separating device according to the present application includes one banknote separating assembly and two banknote pressing assemblies, thus having one banknote separating assembly and one banknote pressing assembly less than that a conventional banknote separating machine has. With two banknote pressing assemblies, banknote clamping and conveying are performed in the processes of banknote disposing, banknote depositing, banknote withdrawing, banknote picking, forgotten banknote recovering, etc., which has a simplified structure, a reduced banknote jamming risk, an improved reliability, thus allowing difficulties in assembling, manufacturing, and testing to be reduced, and the cost to be reduced.

DETAILED DESCRIPTION

Technical solutions in embodiments of the present application will be clearly and fully described hereinafter in conjunction with the accompanying drawings in the embodiments of the present application. Apparently, the described embodiments are only a part, rather than all, of the embodiments of the present application. All other embodiments obtained by those skilled in the art based on the embodiments of the present application without any creative efforts fall within the protection scope of the present application.

Figure 1:
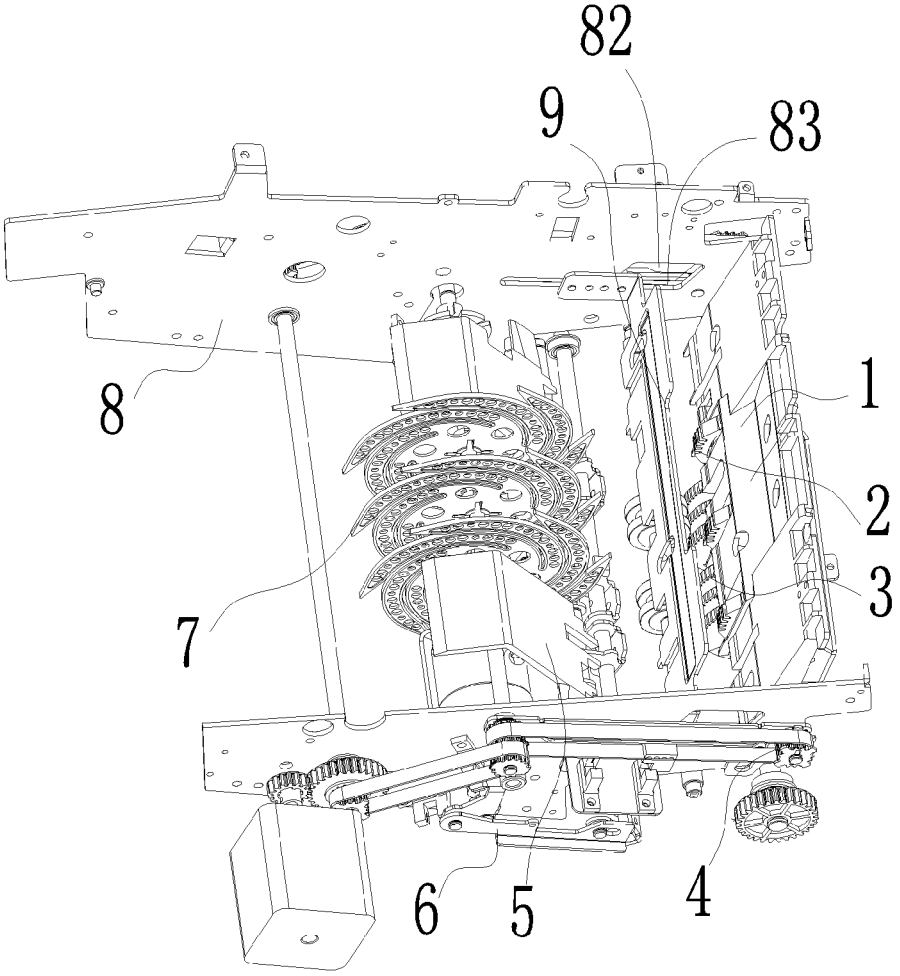
FIG. 1 is a perspective view of a banknote separating device.
Figure 7:
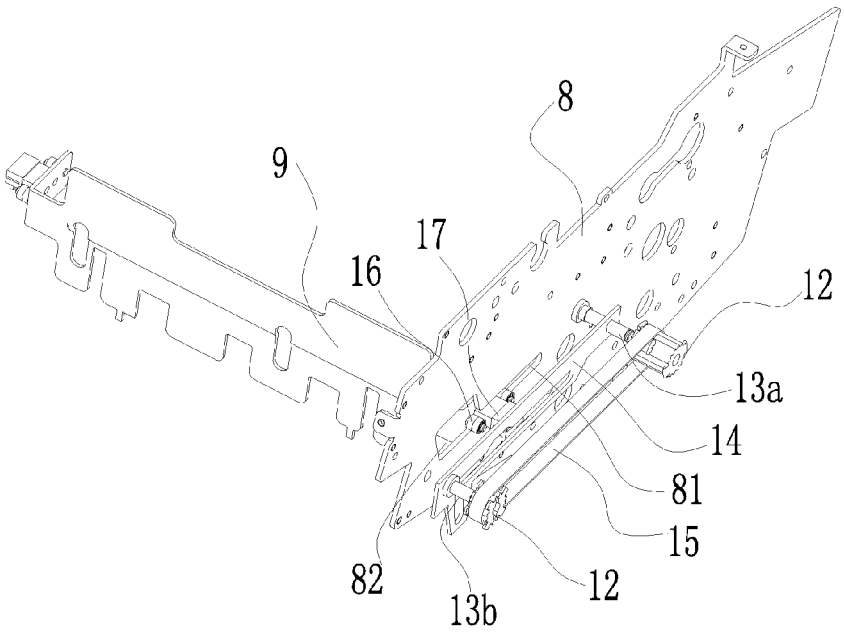
FIG. 7 is a perspective exploded view of a left side of the first banknote pressing assembly 4.
Figure 8:
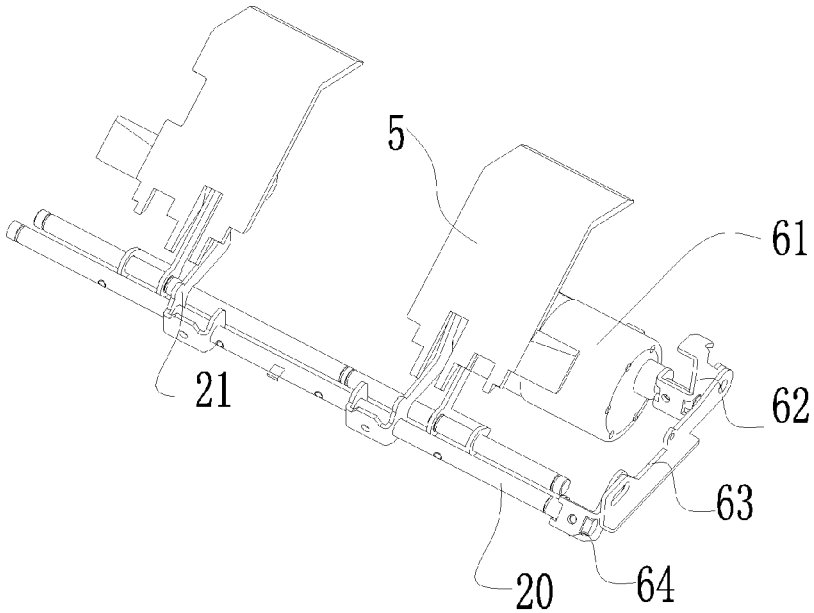
FIG. 8 is a perspective view of a second banknote pressing assembly 6.

Reference is made to FIGS. 1, 7 and 8, a banknote separating device includes a supporting side plate 8, and an impeller wheel assembly 7, a banknote separating assembly including a banknote separating wheel 3, a first banknote pressing assembly 4 and a second banknote pressing assembly 6 mounted on the supporting side plate 8. The first banknote pressing assembly 4 includes a first banknote pressing plate 9, and a synchronous belt pulley mechanism configured to drive the first banknote pressing plate, and the synchronous belt pulley mechanism includes two synchronous pulleys 12 and a synchronous belt 15 sleeved on the synchronous pulleys. One of the synchronous pulleys 12 is mounted at one end of a rotatable plate 14 by a first riveting shaft 13*b*, and another end of the rotatable plate 14 is mounted on the supporting side plate 8 by a second riveting shaft 13*a*. The rotatable plate 14 is rotatable about the second riveting shaft 13*a*. Each of the supporting side plate 8 and the rotatable plate 14 includes a sliding slot. The first banknote pressing plate 9 is mounted in the sliding slot of the rotatable plate 14 via a bearing 16, and extends into the sliding slot 81 of the supporting side plate 8. The first banknote pressing plate 9 is connected to the synchronous belt 17 via a belt connecting plate 15, and moves forward and backward in the sliding slot of the rotatable plate 14 with rotating of the synchronous belt 17. The second banknote pressing assembly 6 includes a second banknote pressing plate 5 and a crank-rocker mechanism configured to drive the second banknote pressing plate. The crank-rocker mechanism includes a direct current motor 61 fixed to the supporting side plate 8, a crank 62 fixed to a motor shaft of the direct current motor, a connecting rod 63 connected to the crank, and a rocker 64 connected to the connecting rod 63. Another end of the rocker 64 is fixed to a shaft 20, and the second banknote pressing plate 5 is also fixed to the shaft 20 by a banknote pressing bracket 21. When the crank-rocker mechanism moves, the rocker 64 rocks back and forth to drive the shaft 20 to rotate back and forth, thus driving the banknote pressing bracket 21 and the second banknote pressing plate 5 fixed on the shaft 20 to rock back and forth.

In addition, referring to FIG. 1, the banknote separating device further includes a banknote baffle 1 and a banknote picking wheel 2, and the banknote separating wheel 3 included in the banknote separating assembly is located below the banknote picking wheel 2. The second banknote pressing plate 5 and the first banknote pressing plate 9 are located in order between the impeller wheel assembly 7 and the banknote baffle 1. A banknote input space may be formed between the banknote baffle 1 and the first banknote pressing plate 9, and a banknote output space may be formed between the first banknote pressing plate 9 and the second banknote pressing plate 5.

In addition, the banknote separating device further includes a pair of first U-shaped sensors U1 and U2. The first U-shaped sensor U1 is configured to detect whether the first banknote pressing plate is lifted in place to avoid the banknote picking wheel, and the first U-shaped sensor U2 is located at a rear side of the banknote picking wheel, and is configured to detect whether the first banknote pressing plate and the banknote picking wheel press the banknote in place to control the starting of the banknote picking wheel.

Preferably, the first banknote pressing assembly further includes a pair of second U-shaped sensors U3 and U6. The second U-shaped sensor U3 is configured to control a position of the first banknote pressing plate in a banknote withdrawing process, and the second U-shaped sensor U6 is configured to control a position of the first banknote pressing plate in a banknote disposing process.

Preferably, the second banknote pressing assembly further includes a pair of third U-shaped sensors U4 and U5. The third U-shaped sensor U5 is configured to control initial positions of the second banknote pressing plate in performing the banknote withdrawing process, the banknote disposing process, and the banknote depositing process. The third U-shaped sensor U4 is configured to control a position of the second banknote pressing plate in a banknote picking process.

In addition, an opening 82 is provided at an end, close to the banknote picking wheel 2, of the sliding slot 81 of the supporting side plate 8, the opening 82 is provided with an inclined surface extending upward, and the first banknote pressing plate 9 is movable upward along the inclined surface. In the process of the first banknote pressing plate 9 moving upward along the inclined surface to be lifted up, the first banknote pressing plate 9 avoids the banknote picking wheel 2, to allow the second banknote pressing plate 5 to directly cooperate with the banknote picking wheel 2 to clamp the banknotes, thus allowing the banknote separating device to perform the function of forgotten banknote recovering.

Reference is made to FIGS. 1 and 7, and a specific structure, a position and a motion relationship of the first banknote pressing assembly 4 are further illustrated. FIG. 1 is a perspective view showing a banknote separating device, and a position of the first banknote pressing assembly 4 in the banknote separating device. FIG. 7 is an exploded perspective view showing a left side of the first banknote pressing assembly 4 according to the present application. The supporting side plate 8 and the rotatable plate 14 are each provided with a sliding slot, and the first banknote pressing plate 9 is mounted on the rotatable plate 14 via the bearing 16. The first banknote pressing plate 9 is slidable in the sliding slots of the supporting side plate and the rotatable plate. The first banknote pressing plate 9 is installed with a belt connecting plate 17, is connected to the synchronous belt 15 via the belt connecting plate 17, and is movable forward and backward together with rotating of the synchronous belt 15. A second riveting shaft 13*a* is riveted on the supporting side plate 8, the rotatable plate 14 is mounted to the second riveting shaft 13*a*, and the rotatable plate 14 is rotatable about the second riveting shaft 13*a*. A first riveting shaft 13*b* is riveted at another end of the rotatable plate 14, and a synchronous pulley 12 is hitched on the first riveting shaft 13*b*, and the synchronous belt 15 is hitched on two synchronous pulleys 12. When the synchronous belt 15 rotates, the first banknote pressing plate 9 moves forward and backward in the sliding slot 81. As shown in FIG. 1, a large opening 82 is provided at a front end of the sliding slot of the supporting side plate 8, and the opening 82 is provided with an inclined surface 83. In the case that the first banknote pressing plate 9 slides in the sliding slot 81 until the bearing 16 at a most front end touches the inclined surface 83, the first banknote pressing plate 9 may slide upward along the inclined surface 83 to achieve the function of lifting the first banknote pressing plate 9 up, to prepare for that the banknotes pressed by the second banknote pressing plate 5 in performing the forgotten banknote recovering process can be in contact with the banknote picking wheel 2 and the banknote separating wheel 3 and the banknote separating can be successfully performed. In this case, the sliding slot of the rotatable plate 14 limits the position of the first banknote pressing plate 9, and the rotatable plate 14 functions as a rotational rocking arm, to allow the first banknote pressing plate 9 to be lifted.

Reference is made to FIGS. 1 and 8, a structure, a position and a motion relationship of the second banknote pressing assembly 6 are described in detail. FIG. 1 is a perspective view showing a banknote separating device, and a position of the second banknote pressing assembly 6 in the banknote separating device. FIG. 8 is a perspective view of the second banknote pressing assembly 6. The second banknote pressing assembly 6 is driven by a crank-rocker mechanism, and a direct current motor 61 is fixed to the supporting side plate 8, and the crank 62 has one end fixed to the motor shaft of the direct current motor 61, and has another end connected to the connecting rod 63. Another end of the connecting rod 63 is connected to a rocker 64. Another end of the rocker 64 is fixed to a rotating shaft 20. The second banknote pressing plate 5 is fixed to the rotating shaft 20 via a banknote pressing bracket 21, and when the crank-rocker mechanism moves, the rocker 64 rocks back and forth, to drive the rotating shaft 20 configured to fix the rocker to rotate back and forth, to drive the banknote pressing bracket 21 and the second banknote pressing plate 5 fixed to the shaft 20 to rock back and forth, thus banknote pressing is performed.

The functions of the banknote separating device according to this embodiment in various processes are specifically described hereinafter in conjunction with drawings.

Figure 2:
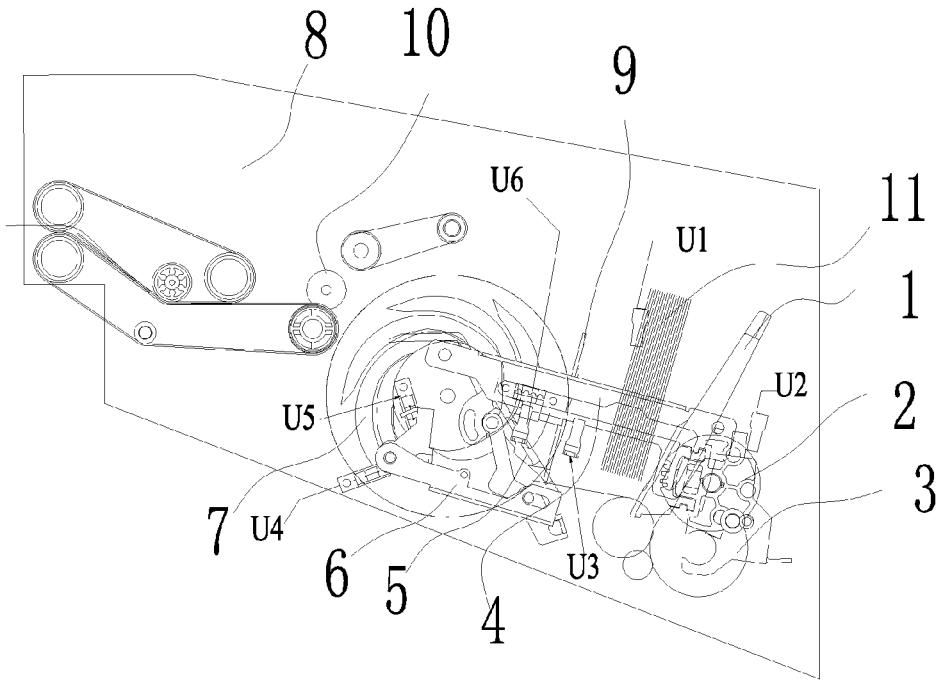
FIG. 2 is a side view of the banknote separating device in performing banknote disposing.

As shown in FIG. 2, in the case that the banknote separating device performs the banknote disposing, the first banknote pressing assembly 4 and the second banknote pressing assembly 6 are respectively located at initial positions shown in FIG. 2, and in this state, the sensors U5 and U6 are blocked, and the banknotes 11 are smoothly disposed into the banknote input space formed by the first banknote pressing plate 9 and the banknote baffle 1.

Figure 3:
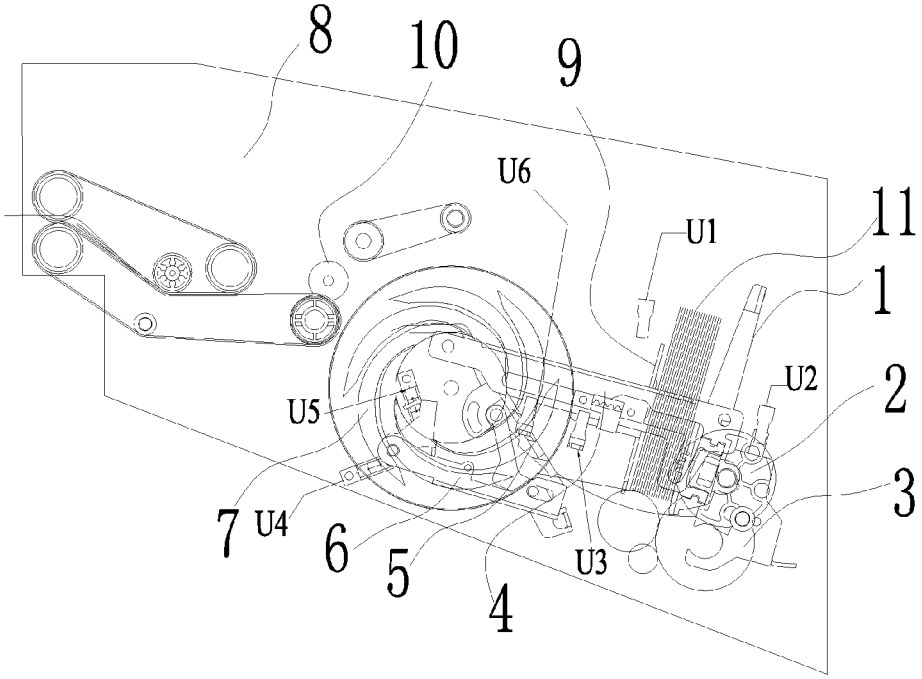
FIG. 3 is a side view of the banknote separating device in performing banknote depositing process.

As shown in FIG. 3, in the case that the banknote separating device performs the banknote depositing process, the first banknote pressing assembly 4 and the second banknote pressing assembly 6 are respectively located at initial positions shown in FIG. 2. The motor of the first banknote pressing assembly 4, via the synchronous belt 15, drives the first banknote pressing plate 9 to move rightward to tightly press the banknotes 11. When the first sensor U2 mounted behind the banknote picking wheel 2 is blocked, the motor of the first banknote pressing assembly 4 stops rotating, the banknotes 11 are clamped by the first banknote pressing plate 9 and the banknote picking wheel 2, and when the banknote picking wheel 2 rotates, the banknotes 11 are driven to enter the banknote separating wheel 3, to be sorted, thus achieving the function of banknote depositing.

Figure 4:
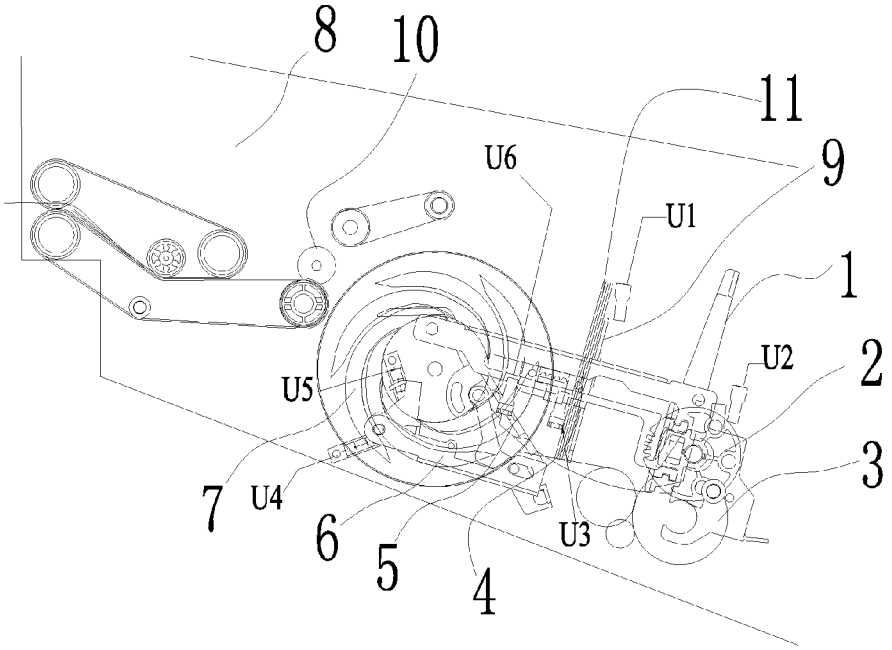
FIG. 4 is a side view of the banknote separating device in performing banknote withdrawing process.

As shown in FIG. 4, in the case that the banknote separating device performs the banknote withdrawing process, the first banknote pressing assembly 4 and the second banknote pressing assembly 6 are respectively located at initial positions shown in FIG. 2. The motor of the first banknote pressing assembly 4, via the synchronous belt 15, drives the first banknote pressing plate 9 to move rightward. When the sensor U3 is blocked, the first banknote pressing plate 9 stops moving rightward, and the first banknote pressing plate 9 is located at a position shown in FIG. 4. The banknotes 11 coming out of the banknote box enter a passage of a banknote outlet, and are clamped by a passage power wheel 10 and are conveyed into the impeller wheel 7, the impeller wheel 7 rotates to drive the banknotes in the impeller wheel to rotate together, till the banknotes hit the inclined surface of the second banknote pressing plate 5 to fall off, and are stacked into the banknote output space formed by the second banknote pressing plate 5 and the first banknote pressing plate 9.

Figure 5:
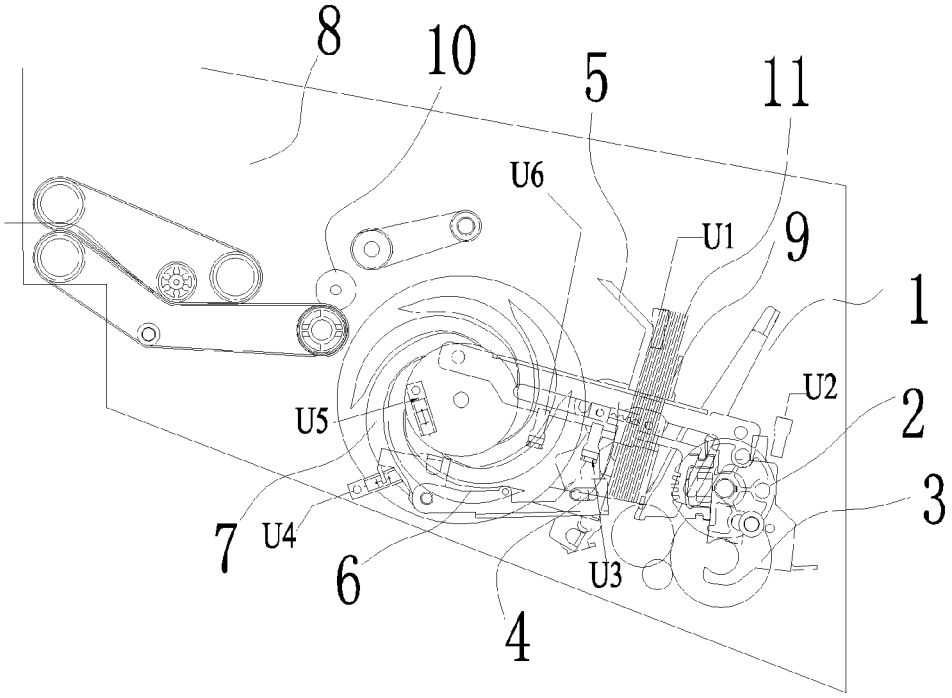
FIG. 5 is a side view of the banknote separating device in performing banknote picking.

As shown in FIG. 5, in the case that a customer prepares to pick the banknotes in the banknote withdrawing process, the first banknote pressing assembly 4 and the second banknote pressing assembly 6 are located at positions shown in FIG. 4. The direct current motor 61 drives the crank 62 to rotate to drive the rocker 64 to rock rightward. The second banknote pressing plate 5 rocks rightward, and presses the banknotes 11 withdrawn onto the first banknote pressing plate 9, and clamps the banknotes together with the first banknote pressing plate 9 to move rightward. When the sensor U5 is blocked, the direct current motor stops rotating, and the second banknote pressing plate 5 stops moving, at this moment, the banknotes are clamped at a position as shown in FIG. 5, and the banknotes may be conveniently taken.

Figure 6:
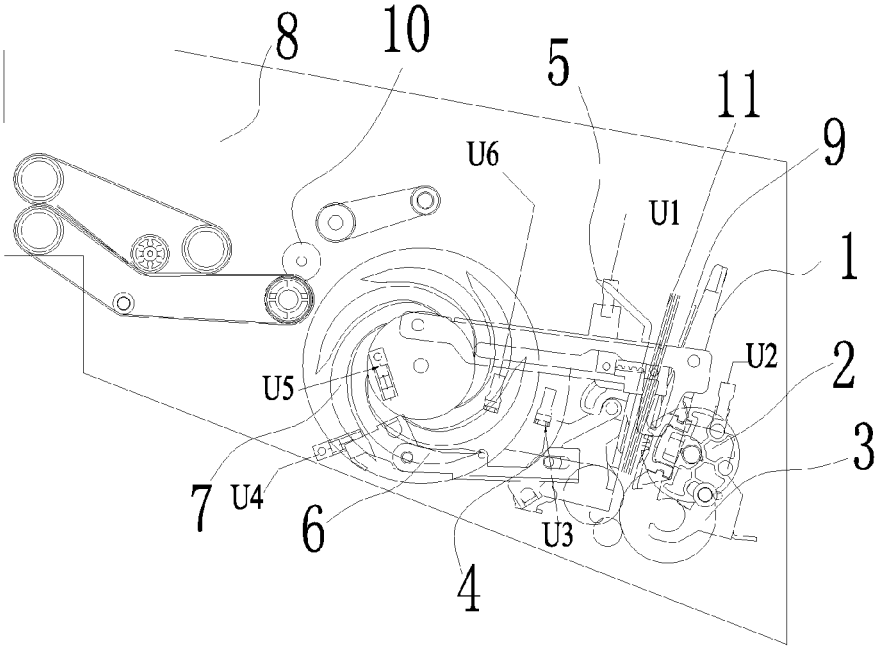
FIG. 6 is a side view of the banknote separating device in performing forgotten banknote recovering process.

As shown in FIG. 6, when the banknote withdrawing process finishes and the customer forgets to take out the banknotes 11 withdrawn, the core of the device may perform the forgotten banknote recovering process, and in such a case, the first banknote pressing assembly 4 and the second banknote pressing assembly 6 are located at positions shown in FIG. 5. The banknotes 11 are clamped between the second banknote pressing plate 5 and the first banknote pressing plate 9. The second banknote pressing plate 5 and the first banknote pressing plate 9 continue to move rightward, and when the first banknote pressing plate 9 moves in the sliding slot 81 to contact with the inclined surface 83 of the sliding slot, as described above, the first banknote pressing plate 9 moves upward along the inclined surface 83 to be lifted up, to avoid the banknote picking wheel 2. The second banknote pressing plate 5 continues to move rightward to press the banknotes. When the first U-shaped sensor U2 mounted behind the banknote picking wheel 2 is blocked, the motor of the second banknote pressing assembly 6 stops rotating, and the banknotes 11 are clamped by the second banknote pressing plate 5 and the banknote picking wheel 2. When the banknote picking wheel 2 rotates, the banknotes 11 are carried to enter the banknote separating wheel 3 and are separated, thus completing the function of forgotten banknote recovering.

Figure 9:
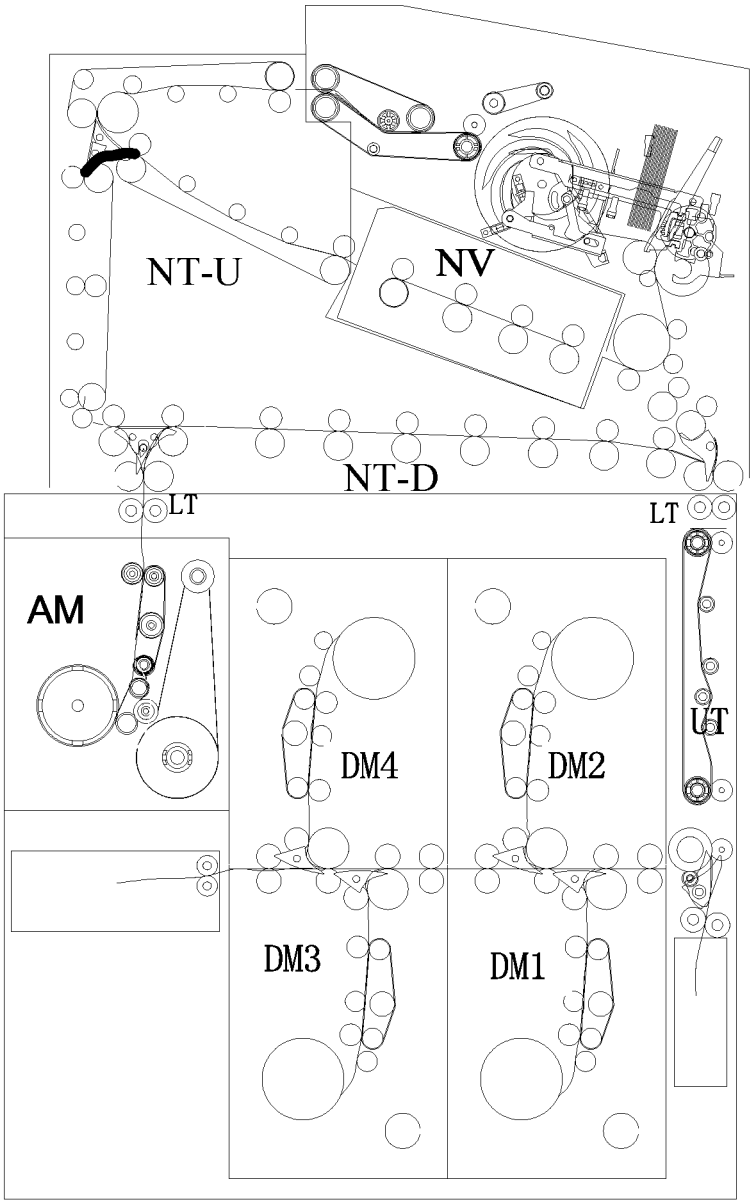
FIG. 9 is a schematic view showing the internal structure of a cash recycling system according to an embodiment of the present application.

As shown in FIG. 9, a cash recycling system is provided according to this embodiment, which employs the above banknote separating device. Other known components in the cash recycling system include, but are not limited to, a housing configured to support and protect internal components in the system, and a human-machine interaction module configured to perform information interacting between the user and the equipment, including but not limited to components such as a keyboard, a display, a card reader, a receipt printer etc. An internal core of the cash recycling system includes a banknote separating module, an identification module, a temporary storage module, a recycling box, a recovering box, and a banknote conveying passage, among which, the banknote separating module is embodied as the banknote separating device shown in FIG. 1.

The banknote separating device according to this embodiment has a simplified structure, a low banknote jamming risk, an improved reliability, thus allowing the difficulties in assembling, manufacturing, and testing to be reduced, and the cost to be reduced.

The above embodiments are only preferable embodiments of the present application and are not intended to limit the protection scope of the present application. Any equivalent variations made based on the specification and drawings of the present application should be deemed to fall into the protection scope of the present application.

The invention claimed is:

1. A banknote separating device, comprising:

a supporting side plate, and an impeller wheel assembly, a banknote separating assembly, a first banknote pressing assembly and a second banknote pressing assembly, which are mounted to the supporting side plate, wherein the first banknote pressing assembly comprises a first banknote pressing plate and a synchronous belt pulley mechanism configured to drive the first banknote pressing plate, the synchronous belt pulley mechanism comprises two synchronous pulleys and a synchronous belt sleeved on the synchronous pulleys, one of the synchronous pulleys is mounted at one end of a rotatable plate by a first riveting shaft, another end of the rotatable plate is mounted on the supporting side plate by a second riveting shaft, and the rotatable plate is rotatable about the second riveting shaft;

each of the supporting side plate and the rotatable plate comprises a sliding slot, the first banknote pressing plate is mounted in the sliding slot of the rotatable plate via a bearing and extends into the sliding slot of the supporting side plate, and the first banknote pressing plate is connected to the synchronous belt via a belt connecting plate and moves forward and backward in the sliding slot of the rotatable plate with rotating of the synchronous belt; and the second banknote pressing assembly comprises a second banknote pressing plate and a crank-rocker mechanism configured to drive the second banknote pressing plate, and the crank-rocker mechanism comprises:

a direct current motor fixed to the supporting side plate, a crank fixed to a motor shaft of the direct current motor, a connecting rod connected to the crank, and a rocker connected to the connecting rod, with another end of the rocker fixed to a shaft; and the second banknote pressing plate is also fixed to the shaft by a banknote pressing bracket.

2. The banknote separating device according to claim 1, further comprising a banknote baffle and a banknote picking wheel, wherein the banknote separating assembly comprises a banknote separating wheel located below the banknote picking wheel.

3. The banknote separating device according to claim 2, wherein the second banknote pressing plate and the first banknote pressing plate are arranged in order between the impeller wheel assembly and the banknote baffle, a banknote input space is formed between the banknote baffle and the first banknote pressing plate, and a banknote output space is formed between the first banknote pressing plate and the second banknote pressing plate.

4. The banknote separating device according to claim 2, further comprising a pair of first U-shaped sensors located on a rear side of the banknote picking wheel, wherein one of the first U-shaped sensors is configured to detect whether the first banknote pressing plate is lifted in place to avoid the banknote picking wheel, and the other one of the first U-shaped sensors is configured to detect whether the first banknote pressing plate and the banknote picking wheel press the banknote in place to control starting of the banknote picking wheel.

5. The banknote separating device according to claim 1, wherein the first banknote pressing assembly further comprises a pair of second U-shaped sensors, one of the second U-shaped sensors is configured to control a position of the first banknote pressing plate in a banknote withdrawing process, and the other one of the second U-shaped sensors is configured to control a position of the first banknote pressing plate in a banknote disposing process.

6. The banknote separating device according to claim 1, wherein the second banknote pressing assembly further comprises a pair of third U-shaped sensors, one of the third U-shaped sensors is configured to control an initial position of the second banknote pressing plate in performing the banknote withdrawing process, the banknote disposing process, and a banknote depositing process respectively, and the other one of the third U-shaped sensors is configured to control a position of the second banknote pressing plate in a banknote picking process.

7. The banknote separating device according to claim 2, wherein an opening is provided at an end, close to the banknote picking wheel, of the sliding slot of the supporting side plate, and the opening is provided with an inclined surface extending upward, and the first banknote pressing plate is movable upward along the inclined surface.

8. A cash recycling system, comprising the banknote separating device according to claim 1.

9. A cash recycling system, comprising the banknote separating device according to claim 2.

10. A cash recycling system, comprising the banknote separating device according to claim 3.

11. A cash recycling system, comprising the banknote separating device according to claim 4.

12. A cash recycling system, comprising the banknote separating device according to claim 5.

13. A cash recycling system, comprising the banknote separating device according to claim 6.

14. A cash recycling system, comprising the banknote separating device according to claim 7.

* * * * *